US010987719B2

(12) United States Patent
Kurosawa et al.

(10) Patent No.: US 10,987,719 B2
(45) Date of Patent: Apr. 27, 2021

(54) CAN FILLING/SEAMING DEVICE AND CAN FILLING/SEAMING METHOD

(71) Applicant: TOYO SEIKAN CO., LTD., Tokyo (JP)

(72) Inventors: Kazuyuki Kurosawa, Tokyo (JP); Hidehiko Yuse, Tokyo (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 597 days.

(21) Appl. No.: 15/538,378

(22) PCT Filed: Dec. 16, 2015

(86) PCT No.: PCT/JP2015/085207
§ 371 (c)(1),
(2) Date: Jun. 21, 2017

(87) PCT Pub. No.: WO2016/114060
PCT Pub. Date: Jul. 21, 2016

(65) Prior Publication Data

US 2017/0348757 A1 Dec. 7, 2017

(30) Foreign Application Priority Data

Jan. 15, 2015 (JP) ..... JP2015-006268

(51) Int. Cl.
*B21D 51/32* (2006.01)
*B21D 51/26* (2006.01)
(Continued)

(52) U.S. Cl.
CPC ..... *B21D 51/32* (2013.01); *B21D 51/2661* (2013.01); *B21D 51/30* (2013.01);
(Continued)

(58) Field of Classification Search
CPC .. B65B 7/28; B65B 57/14; B67B 3/02; B67B 3/06; B67B 3/18; B67C 3/12; B67C 3/22; B67C 7/0046; B67C 3/20
See application file for complete search history.

(56) References Cited

U.S. PATENT DOCUMENTS 3,364,652 A 1/1968 Groth et al.
3,415,037 A * 12/1968 Bergeron ..... B65B 7/28 53/308
(Continued)

FOREIGN PATENT DOCUMENTS

DE 1432416 A1 11/1968
DE 8916109 U1 10/1993
(Continued)

OTHER PUBLICATIONS

Office Action issued in Japan Counterpart Patent Appl. No. 2015-006268, dated Sep. 24, 2019, along with an English translation thereof.
(Continued)

*Primary Examiner* — Andrew M Tecco
*Assistant Examiner* — Nicholas E Igbokwe
(74) *Attorney, Agent, or Firm* — Greenblum & Bernstein, P.L.C.

(57) ABSTRACT

A can filling/seaming device that fills a can with a liquid content and seals the can with a lid by double-seaming allows a filler and a seamer to be integrated in a compact arrangement. A can filling/seaming device includes a filler that fills a can with a liquid content while conveying the can by rotation of a filling turret, a seamer that attaches a lid to the can filled with the content by double-seaming, and a forwarding turret provided between a carrying-out position of the filling turret and a carrying-in position to the seamer
(Continued)

to circularly convey the can filled with the content, wherein a lid supply part is provided on the forwarding turret.

11 Claims, 4 Drawing Sheets

(51) Int. Cl.

| | |
|---|---|
| ***B65B 57/14*** | (2006.01) |
| ***B67C 3/12*** | (2006.01) |
| ***B67C 3/22*** | (2006.01) |
| ***B21D 51/30*** | (2006.01) |
| ***B67B 3/02*** | (2006.01) |
| ***B65B 7/28*** | (2006.01) |
| ***B67C 7/00*** | (2006.01) |
| ***B67B 3/06*** | (2006.01) |

(52) U.S. Cl.
CPC ..... *B65B 7/28* (2013.01); *B67B 3/02* (2013.01); *B67B 3/06* (2013.01); *B67C 7/0046* (2013.01); *B65B 57/14* (2013.01); *B67C 3/12* (2013.01); *B67C 3/22* (2013.01)

(56) References Cited

U.S. PATENT DOCUMENTS

| | | | | |
|---|---|---|---|---|
| 4,277,928 | A * | 7/1981 | Ahlers | B67B 3/06 53/67 |
| 4,467,908 | A * | 8/1984 | Schneider | B65G 47/846 198/441 |
| 4,993,537 | A * | 2/1991 | Bianchini | B65B 7/2807 198/395 |
| 5,050,369 | A | 9/1991 | Fiwek et al. | |
| 5,335,474 | A | 8/1994 | Rietschi et al. | |
| 6,213,309 | B1 | 4/2001 | Dadisho | |
| 7,568,573 | B2 * | 8/2009 | Schill | B65G 47/5154 198/438 |
| 2004/0159697 | A1 * | 8/2004 | Turner | B21D 51/2653 228/124.6 |
| 2014/0360621 | A1 * | 12/2014 | Clusserath | B67C 3/202 141/9 |

FOREIGN PATENT DOCUMENTS

| | | | |
|---|---|---|---|
| EP | 0544617 | A1 | 6/1993 |
| EP | 2179960 | A1 | 4/2010 |
| JP | 49-47328 | | 12/1974 |
| JP | 52-125541 | | 9/1977 |
| JP | 60-101496 | | 7/1985 |
| JP | 9-142649 | | 6/1997 |
| JP | 2001-287794 | | 10/2001 |
| JP | 2002-019725 | | 1/2002 |
| JP | 2002-102970 | | 4/2002 |
| JP | 2002-284289 | | 10/2002 |
| JP | 2005-075432 | | 3/2005 |
| JP | 2005-145478 | | 6/2005 |
| JP | 2006-036266 | | 2/2006 |
| JP | 2006-151483 | | 6/2006 |
| JP | 2007-191166 | | 8/2007 |
| WO | 00/66282 | A1 | 11/2000 |

OTHER PUBLICATIONS

Office Action issued in India Counterpart Patent Appl. No. 201737020980, dated Jul. 10, 2019.
Foreign Office Action issued in JP Application No. 2015-006268 dated Dec. 4, 2018.
Supplementary European Search Report in EP 15 87 8011, dated Sep. 13, 2018.
Office action for corresponding Chinese patent application No. 201580073570.6 dated Sep. 28, 2018.
Office Action issued in Japan Counterpart Patent Appl. No. 2015-006268, dated Mar. 5, 2019, along with an English translation thereof.
International Search Report issued in Patent Application No. PCT/JP2015/085207, dated Feb. 16, 2016.
China Office action for corresponding Chinese patent application No. 201580073570.6, dated Jun. 4, 2019.
Written Opinion of the International Searching Authority in PCT/JP2015/085207 dated Feb. 16, 2016 with English translation thereof.
Office action for corresponding Indonesian patent application No. P00201705243 dated Jan. 20, 2020.
Office Action received in European patent application No. 15 878 011.4, dated May 15, 2020.

* cited by examiner

CAN FILLING/SEAMING DEVICE AND CAN FILLING/SEAMING METHOD

TECHNICAL FIELD

The present invention relates to a can filling/seaming device and a can filling/seaming method for filling a can with a content and seaming a lid to a can.

BACKGROUND ART

A conventional filling/seaming device includes a rotary filling machine (filler) that successively fills a can of a metal material with a liquid content such as a beverage, and a seaming machine (seamer) that successively seals a lid (metal lid) to a flange part of the filled can by seaming. A filler generally used has a plurality of holding parts (pockets) provided at the circular outer circumference of a rotating filling turret to receive and hold a can, and a filling nozzle that moves in synchronization with each of the holding parts is provided above the holding part. Successively supplied cans are sequentially held by the filling turret of the filler and then filled with a prescribed amount of liquid content from the respective filling nozzles while being conveyed by the rotation of the filling turret. The filled cans once removed from the filling turret are transported to a feeding conveyer or a hook-up conveyer and conveyed to the seamer. The seamer sequentially supplies lids to the flange parts of the filled cans supplied from the feed conveyer or the hook-up conveyer, and the flange parts of the cans and the curled parts of the lids are joined by double-seaming by roll processing, so that the lids are attached and sealed to the cans (see PTL 1).

CITATION LIST

Patent Literature

[PTL 1]
Japanese Patent Application Publication No. 2006-36266

SUMMARY OF INVENTION

Technical Problem

The filling/seaming devices are designed in various forms for different uses, and particularly when a can filled with a liquid content is sealed with a lid by seaming, it is inevitable to take precautions to prevent the content from spilling from the can in a conveyance path between the filling of the content and the seaming with the lid.

Therefore, the conventional filling/seaming device described above has a relatively long linear intermediate conveyance path by a feeding conveyer or a hook-up conveyer between the filler and the seamer, so that the can filled with the content is not subject to high acceleration or centrifugal force during the conveyance in the path.

However, in the conventional filling/seaming device, the presence of the linear intermediate conveyance path necessitates a certain distance to be secured between the filler and the seamer, which prevents these elements from being integrated into a compact arrangement. Positional adjustment is necessary between the carrying-out position of the filler and the receiving position of the linear intermediate conveyance path, and timing adjustment is necessary for transport from the filler to the intermediate conveyance path, which may complicate installation works and prolong the number of days for the device to be set up for operation. In daily use, the timing may be deviated because of the expansion of a conveyer chain for example, and periodic inspection and adjustment should be carried out. Furthermore, if a special driving device is employed to alleviate the timing adjustment between the filler and the seamer, the cost increase may be inevitable.

The present invention is for example directed to a solution to such problems. More specifically, an object of the invention is to allow the filler and the seamer to be integrated in a compact arrangement in a can filling/seaming device and a can filling/seaming method for filling a can with a liquid content and seaming a lid, another object is to simplify installation works and reduce the number of days for the device to be set up for operation by eliminating the necessity of positional adjustment and timing adjustment during transport from the filler to the intermediate conveyance path and from the intermediate conveyance path to the seamer, yet another object is to reduce works related to timing deviation inspection and timing adjustment in daily use, and a still further object is to reduce the manufacturing cost by eliminating the necessity of using a special driving device for timing adjustment.

Solution to Problem

In order to achieve the objects, a can filling/seaming device and a can filling/seaming method according to the present invention includes the following features.

The can filling/seaming device includes a filler that fills a can with a liquid content while conveying the can by rotation of a filling turret, a seamer that attaches a lid to the can filled with the content by double-seaming, and a forwarding turret provided between a carrying-out position of the filling turret and a carrying-in position to the seamer to circularly convey the can filled with the content, wherein a lid supply part is provided on the forwarding turret.

The can filling/seaming method includes filling a can with a liquid content while conveying the can along a circular conveyance path of a filling turret, transporting the can filled with the content from the filling turret to a forwarding turret and supplying the can with a lid while conveying the can along a circular conveyance path of the forwarding turret, and transporting the can supplied with the lid from the forwarding turret to a seamer and attaching the lid to the can by double-seaming while conveying the can along a circular conveyance path of the seamer.

Advantageous Effects of Invention

According to the present invention including such features, when a can is filled with a liquid content and seamed with a lid, a filler that fills the can with the content and the seamer that seams the lid to the can may be integrated through a forwarding turret in a compact arrangement, so that the installation area can be reduced. During the process, acceleration (curvature) is limited at the forwarding turret so that the content filled in the can does not spill from the can, and therefore the installation area can be reduced while keeping high filling accuracy.

Positional adjustment and timing adjustment during transport from the filler to the forwarding turret or from the forwarding turret to the seamer can be abolished, so that installation works can be simplified and the number of days for the device to be set up for operation can be reduced. In daily use, works related to timing deviation inspection or timing adjustment can be reduced, and use of a special driving device for timing adjustment is not necessary, which can lower the manufacturing cost.

DESCRIPTION OF EMBODIMENTS

Figure 1:
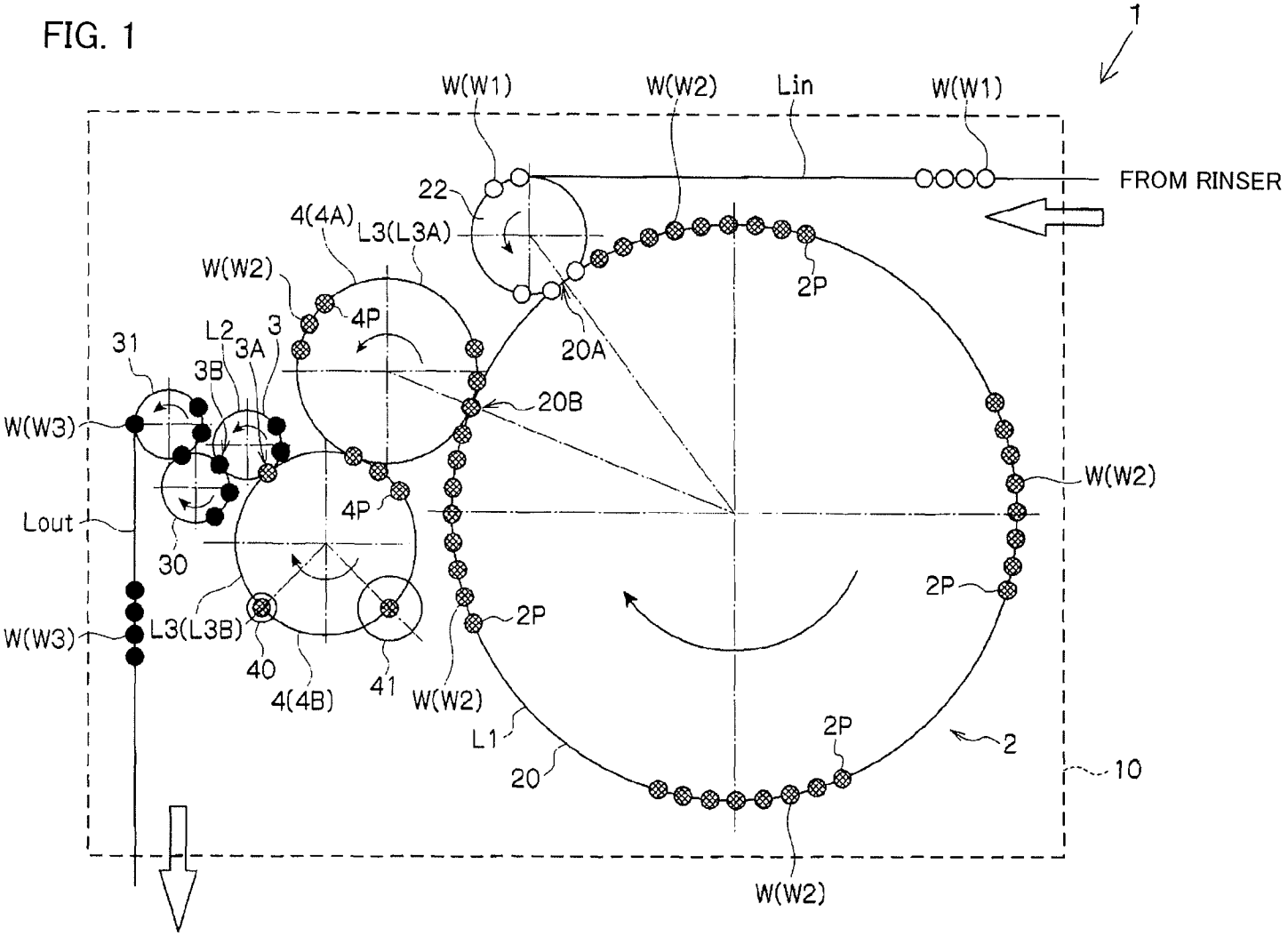
FIG. 1 is a view for illustrating a can filling/seaming device according to one embodiment of the present invention.

Now, embodiments of the present invention will be described in conjunction with the accompanying drawings. In FIG. 1, a can filling/seaming device 1 according to an embodiment of the present invention includes a filler 2, a seamer 3, and a forwarding turret 4. The can W to be described herein is a can having a flange part at the open end, and W1 designates an empty can, W2 designates a can that is being filled with a liquid content such as a beverage or is already filled with the content, and W3 designates a can sealed with a lid by double-seaming in the drawings.

The filler 2 includes a filling turret 20 and fills a can W with a liquid content while conveying the can W by rotation of the filling turret 20. The filling turret 20 includes a plurality of pockets 2P that hold cans W at its circular outer circumference, and the pockets 2P are arranged at a set conveyance pitch P1 in a circular conveyance path L1 with a pitch diameter D1. A filling nozzle (not shown) that moves in synchronization with each of the pockets 2P is provided above the pocket 2P, and the filling nozzle fills the can W with a liquid content between the carrying-in position 20A and the carrying-out position 20B of the filling turret 20.

The can W (empty can W1) is supplied to the filler 2 via an appropriate carrying-in path $L_{in}$ from a rinser that cleans the cans W. As shown, during the process, a carrying-in turret 22 that receives and delivers the cans W to the pockets 2P of the filling turret 20 or a rinser turret (not shown) that cleans the cans W may be additionally provided to the carrying-in turret 22.

The seamer 3 attaches a lid to the flange part of the can filled with the content, by double-seaming by roll processing, and while a can W, on which a lid is placed, is conveyed in a circular conveyance path L2 from a carrying-in position 3A to a carrying-out position 3B, the flange part of the can and the curled part of the lid are subjected to double-seaming by roll processing, so that the can W is sealed. A pitch diameter D2 and a conveyance pitch P2 are set as appropriate in the circular conveyance path L2 of the seamer 3.

The can W carried out from the seamer 3 is carried outside the device via an appropriate carrying-out path $L_{out}$. In the path, if necessary, a discharging turret 30 that receives and forwards the can W discharged from the seamer 3 while rotating in the direction of the shown arrow may be provided, or an inspector turret 31 that carries out various kinds of inspection including inspection about a filling amount with respect to the can W discharged from the discharging turret 30 may be provided.

As for the forwarding turret 4, two forwarding turrets 4A and 4B are provided between the carrying-out position 20B of the filling turret 20 and the carrying-in position 3A of the seamer 3 and circularly convey the can W filled with the content, and pockets 4P are provided at respective conveyance pitches P3A and P3B in the circular conveyance paths L3A and L3B with respective pitch diameters D3A and D3B. Note that while the pitch diameters D3A and D3B of the forwarding turrets 4A and 4B are equal and the conveyance pitches P3A and P3B are equal in this example, the arrangement is not limited to the above.

The forwarding turret 4B between the forwarding turrets 4A and 4B is provided with a lid supply part 40 in the circular conveyance path L3B. The lid supply part 40 may be a lid supply device directly provided in the circular conveyance path L3B or may be provided on an additional lid supply turret provided in the carrying-in position 3A to the seamer 3 in the circular conveyance path L3B. The forwarding turret 4B may include, if necessary, a liquid nitrogen filling part 41 provided in the circular conveyance path L3B to fill the can W with liquid nitrogen so that the can is kept under positive pressure and reduced in the thickness.

Note that while one forwarding turret 4 may be provided, if two of them are provided as shown in FIG. 1, the first forwarding turret 4A may be dedicated to conveyance of the cans W, so that the filling nozzle of the filler 2 needs only to avoid the can W in the carrying-out position 20B of the filling turret 20. As a result, the filling nozzle may be set in a low level, the rotation angle of the filler 2 allocated for filling may be increased, and the filler 2 may be reduced in size.

In such forwarding turrets 4A and 4B, the cans W filled with the content and transported from the carrying-out position 20B of the filling turret 20 to the forwarding turrets 4A and 4B are filled with nitrogen if necessary while moving in the respective circular conveyance paths L3A and L3B, and then the cans W have lids placed at the flange parts thereof at the lid supply part 40 and are transported to the seamer 3.

Figure 4:
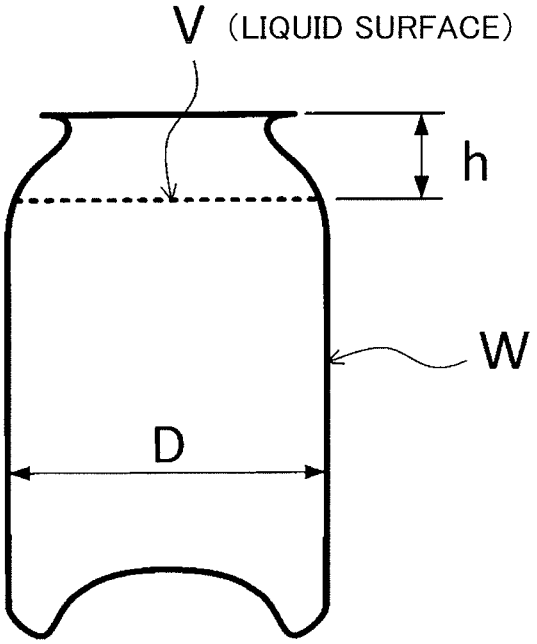
FIG. 4 is a reference view of a can filled with a content.

The cans W filled with the content and transported to the forwarding turrets 4A and 4B are subject to acceleration (centrifugal force) by moving in the circular conveyance paths L3A and L3B. As shown in FIG. 4, an allowable acceleration $a_{max}$ during the process is represented by $a_{max}=(2h/D)\times G$ where h is the headspace height of the can W filled with the content, D is the diameter of the can, and G is the gravitational acceleration, and the pitch diameters D3A and D3B and conveyance pitches P3A and P3B of the forwarding turrets 4A and 4B are set so that the allowable acceleration $a_{max}$ is not exceeded. In this way, the acceleration applied on the cans W is limited, and therefore the cans W can move in the circular conveyance paths L3A and L3B of the forwarding turrets 4A and 4B while the filled content can be prevented from spilling from the open ends of the cans W. Here, the allowable acceleration $a_{max}$ for a typical can is for example expressed by $a_{max}=2\times14/66\times9.81=4.16$ m/s$^2$ when the can normally has a diameter (body diameter) D of 66 mm, a headspace height h of 14 mm, and a gravitational acceleration G of 9.81 m/s$^2$.

In the filling/seaming device 1, it is preferable that the conveyance pitches P1, P2, P3A, and P3B of the filling turret 20 of the filler 2, the seamer 3, and the forwarding turrets 4A and 4B are all equal. However, the conveyance pitches P1, P2, P3A, and P3B may have difference in an allowable range, and the device can still be designed. In particular, the conveyance pitch (pocket pitch) P1 of the filling turret 20 and the conveyance pitches (pocket pitches) P3A and P3B of the forwarding turrets 4A and 4B need only be in the range that enables pocket pass in the transport from the filling turret 20 to the forwarding turrets 4A and 4B.

An example of the specifications of the filling/seaming device 1 is given in Table 1. Here, the production capacity is 600 CPM (Cans Per Minute i.e. production per minute), the conveyance pitches P1, P2, P3A, and P3B are all 31π (97.4 mm), and the conveyance speed is constant at 0.97 m/s. In this example, the centrifugal acceleration (3.82 $m/s^2$) of the forwarding turrets 4A and 4B is set in the allowable range where the acceleration $a_{max}$ is 4.16 $m/s^2$.

TABLE 1

| | Number of pockets | Pitch diameter (mm) | Centrifugal acceleration ($m/s^2$) |
|---|---|---|---|
| Filler | 50 | 1550 | 1.22 |
| Forwarding turret | 16 | 496 | 3.82 |
| Seamer | 6 | 186 | 10.20 |

Note that there is another typical can having a diameter (body diameter) D of 53 mm which is slightly smaller than the diameter of the above described can, and the can normally has a headspace height h of 15 mm, so that $a_{max}=2\times15/53\times9.81=5.55$ $m/s^2$, which is within the allowable range where the acceleration $a_{max}$ is 5.55 $m/s^2$.

Therefore, the centrifugal acceleration ($a_{max}$) of the forwarding turrets 4A and 4B is set less than acceleration defined by the expression $a_{max}=(2h/D)\times G$.

In the filling/seaming device 1, the filler 2 and the seamer 3 are coupled by the forwarding turrets 4A and 4B, so that the filler 2 and the seamer 3 may be integrated in a compact arrangement through the forwarding turrets 4A and 4B. In this way, the filler 2, the seamer 3, and the forwarding turrets 4A and 4B can be provided on a common frame 10. When the filling/seaming device 1 is produced with the common frame 10, works related to assembly wiring and test run adjustment in the installed state may be finished in advance, and therefore the time for installation works may be reduced.

The cans W are all turret-conveyed at accurately determined conveyance pitches from the filler 2 to the seamer 3, so that the process is not influenced by change with time that would be caused by the expansion of a chain used in linear conveyance, and positional adjustment and timing adjustment that would otherwise be necessary in transport from the filler 2 to the forwarding turrets 4A and 4B and from the forwarding turrets 4A and 4B to the seamer 3 can be abolished by making the conveyance pitches P1, P2, P3A, and P3B close to one another.

Note that although not shown, only one forwarding turret 4 may be provided and in the case, the lid supply part 40 and the liquid nitrogen filling part 41 are provided in the circular conveyance path L3. Using one forwarding turret 4, a lid supply turret may serve both to deoxidize the headspace of the can W with a replacement gas and supply the lid, and in the case, the filling nozzle of the filler 2 must avoid the lid supply turret positioned above the can W in the carrying-out position 20B of the filling turret 20. Therefore, the filling nozzle must be set in a high position, must finish filling in an early stage and then must be raised, and the rotation angle of the filler 2 allocated for filling is reduced, so that the filler 2 is increased in size. However, a separate lid supply turret (lid supply part 40) that carries out deoxidization and supply of the lid may be provided in the carrying-in position 3A for the can W from the forwarding turret 4 to the seamer 3, so that the rotation angle of the filler 2 allocated for filling can be increased.

Note that according to the embodiment, it is preferable that when the liquid content is a content sensitive to oxidization such as a tea beverage and beer, the filling/seaming device is formed in a box structure surrounded by covers entirely or partly until a lid is sealed by seaming after filling, and the inside is kept under positive pressure with an inert gas for the purpose of deoxidization or with filtered air for the purpose of preventing contamination and improving the hygiene state.

Figure 2:
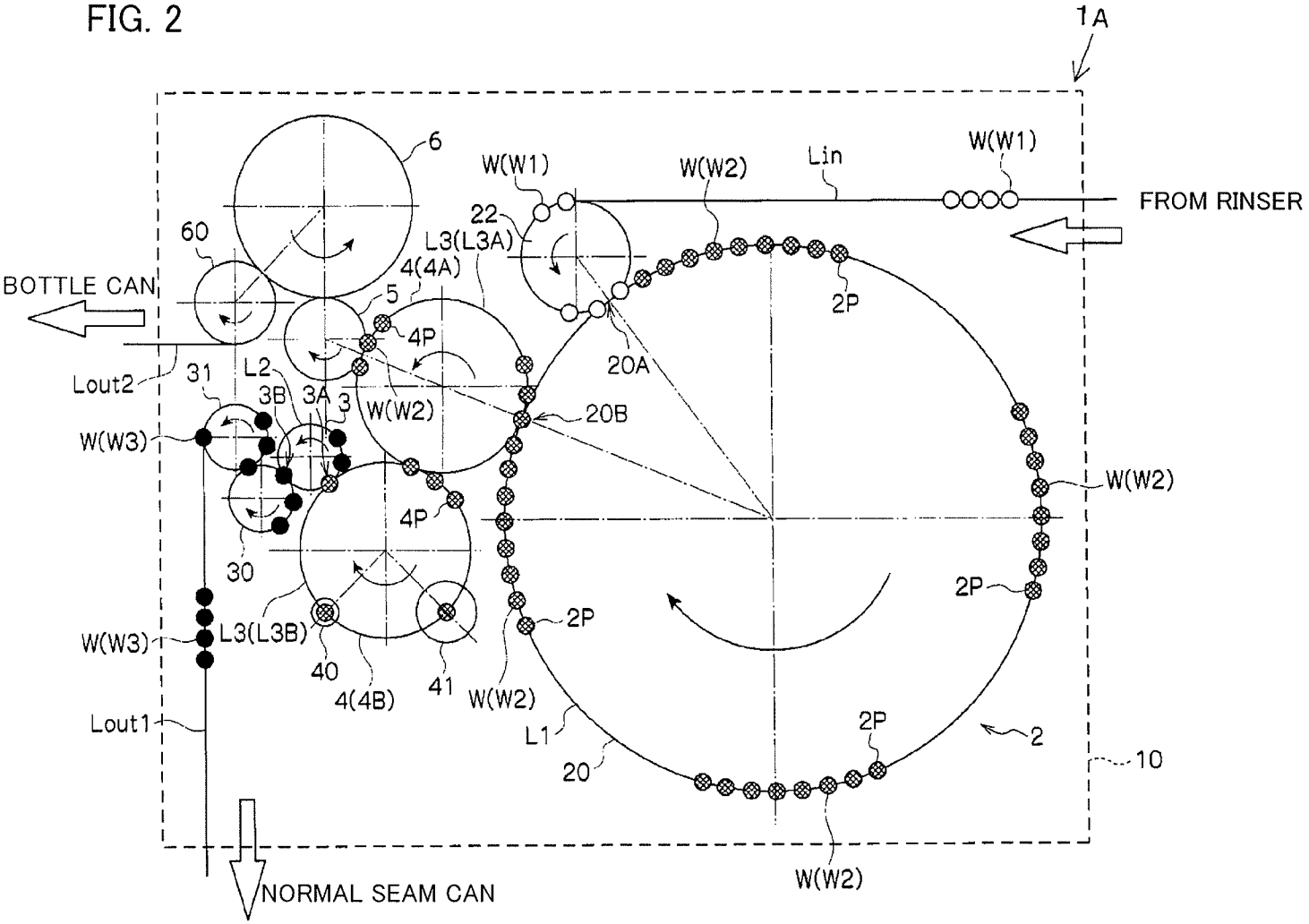
FIG. 2 is a view for illustrating a can filling/seaming device according to another embodiment of the present invention.

FIG. 2 is a view of a filling/seaming device 1A according to another embodiment of the invention. The same elements as those according to the above-described embodiment are designated by the same reference characters, and their description will not be repeated. The embodiment is related to an example having both a carrying-out path $L_{out}$1 for producing a normal seam can sealed with a lid by double-seaming and a discharge path $L_{out}$2 for forming a small-diameter mouth part at a can and producing a bottle can sealed with a cap (metal cap) and the like, the filler 2 and the forwarding turret 4A out of the two forwarding turrets 4A and 4B are both used, and a branching forwarding turret 5 that branches a conveyance path to a capper 6 for capping a cap to the mouth part of the bottle can is provided in the conveyance path L3A of the forwarding turret 4A.

In this way, when a bottle can is filled and capped with a cap, the bottle can W filled with a content by the filler 2 is conveyed from the forwarding turret 4A via the branching forwarding turret 5 to the capper 6 and capped with a cap while being conveyed at the capper 6. The bottle can W discharged from the capper 6 is discharged outside the device through a discharge path $L_{out}$2 via an inspector turret 60 that carries out various kinds of inspection including inspection about a filling amount. On the other hand, when a normal seam can is filled and sealed with a lid by double-seaming, the can is transported from the forwarding turrets 4A and 4B to the seamer 3 in the conveyance path L3 of the forwarding turrets 4A and 4B without using the branching forwarding turret 5.

In such filling/seaming device 1A, the filler 2, the seamer 3, the forwarding turrets 4A and 4B, the branching forwarding turret 5, the capper 6 and the like may be integrated in a compact arrangement, and these elements can be provided on a common frame 10.

Figure 3:
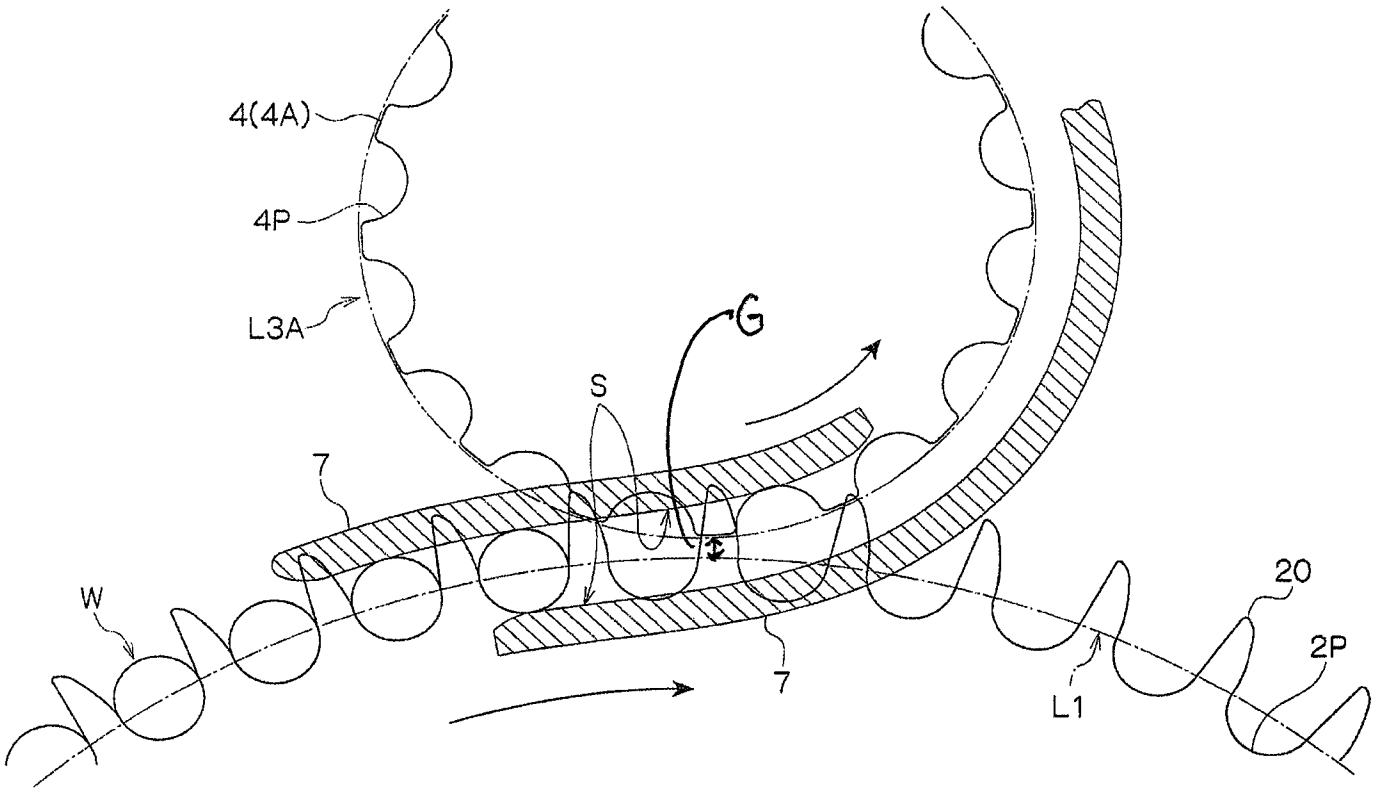
FIG. 3 is a view for illustrating a transport portion between turrets in a can filling/seaming device according to an embodiment of the invention.

FIG. 3 is a view of an exemplary configuration of a transport portion between turrets in a can filling/seaming device according to an embodiment of the invention. When a can is delivered and conveyed between turrets like when the can is transported from the filling turret 20 to the forwarding turret 4A, the curvatures of the circular conveyance paths of one turret and the other turret are inverted, so that acceleration change applied on the can is infinite. Therefore, a liquid-filled can conveyed by one turret has its liquid surface inclined by centrifugal force received during the conveyance, and then when the can is transported to the other turret, the liquid surface is inclined to the opposite side, and the liquid surface vibrates and is prone to a problem such as spilling or foaming. This may be disadvantageous in transport of the can after the can is filled, particularly at the filling/seaming device that fills the can with a liquid content and seals the lid to the can by double-seaming mentioned above. Acceleration change applied on the can is infinite, so that the can that is conveyed becomes unstable in position and may interfere with, e.g., a transport guide or the pockets of the turret, which may cause a defect such as a damage and a dent on the can.

In order to address the problem, in the example shown in FIG. 3, an acceleration relaxation curve S that continuously changes the acceleration applied on the can W that is conveyed is provided in the transport portion from the filling turret 20 to the forwarding turret 4A. More specifically, while the can W is transported between the filling turret 20 having pockets 2P formed at the conveyance pitch P1 at the outer circumference and the forwarding turret 4A having pockets 4P formed at the conveyance pitch P3A at the outer circumference, the circular conveyance path L1 of the filling turret 20 and the circular conveyance path L3A of the forwarding turret 4A are provided with a prescribed gap "G" therebetween, in which a transport guide 7 that transports the can W along a prescribed track is provided. The guide surface shape of the transport guide 7 is formed along a transition curve (the acceleration relaxation curve S) that continuously changes from the pitch circle curvature of the circular conveyance path L1 of the filling turret 20 to the pitch circle curvature of the circular conveyance path L3A of the forwarding turret 4A.

The acceleration relaxation curve S is provided in the transport portion for the can W between the filling turret 20 and the forwarding turret 4A, so that the liquid surface of the can W filled with a liquid content can be suppressed from vibrating during the transport. In this way, the problem such as spilling and foaming of the content during the transport of the can between the filling turret 20 and the forwarding turret 4A can be solved. Note that while the transport portion between the filling turret 20 and the forwarding turret 4A has been described here, transport along an acceleration relaxation curve for the same purpose can be carried out in the transport portions between the forwarding turret 4A and the forwarding turret 4B and between the forwarding turret 4B and the seamer 3, and the same advantageous effect can be obtained.

As in the foregoing, when the can filling/seaming device 1 (1A) according to the embodiments of the present invention fills a can with a liquid content and seals the can with a lid by double-seaming, the filler 2 and the seamer 3 are coupled by the forwarding turret 4 (4A, 4B), so that use of a linear intermediate conveyance path or a special driving device for timing adjustment may be abolished, which can reduce the installation cost and the installation area. The acceleration (curvature) is limited at the forwarding turret 4 so that the content filled in the can does not spill from the can, transport in, for example, the transport portion from the filling turret 20 to the forwarding turret 4 (4A, 4B) is carried out along the acceleration relaxation curve, and therefore the installation area can be reduced while keeping high filling accuracy. The forwarding turret 4 (4A, 4B) may be provided with the lid supply part 40 or the liquid nitrogen filling part 41, and therefore the device may be provided in a compact form.

As in the foregoing, while the embodiments of the present invention have been described in detail with reference to the accompanying drawings, the specific configurations of the embodiments should not be construed as limiting, design changes and the like without departing from the gist of the invention are covered by the invention. The embodiments described above may have two or more of their features combined between each other unless their purposes, configurations and the like are contradictory to one another or a problem arises in doing so. In particular, the example shown in FIG. 3 may be employed for all the transport portions among turrets according to the embodiments shown in FIG. 1 and FIG. 2.

REFERENCE SIGNS LIST

1, 1A Filling/seaming device
2 Filler
20 Filling turret
20A Carrying-in position
20B Carrying-out position
22 Carrying-in turret
3 Seamer
3A Carrying-in position
3B Carrying-out position
30 Discharging turret
31, 60 Inspector turret
4 (4A, 4B) Forwarding turret
40 Lid supply part
41 Liquid nitrogen filling part
5 Branching forwarding turret
6 Capper
7 Transport guide
10 Common frame
W Can
L1, L2, L3 (L3A, L3B) Circular conveyance path
$L_{in}$ Carrying-in path
$L_{out}$, $L_{out}$1, $L_{out}$2 Carrying-out path
2P, 4P Pocket
S Acceleration relaxation curve

The invention claimed is:

1. A can filling/seaming device, comprising:

a filler that fills a can with a liquid content while conveying the can by rotation of a filling turret;

a seamer that attaches a lid to the can filled with the content by double-seaming; and a forwarding turret provided between a carrying-out position of the filling turret and a carrying-in position to the seamer to circularly convey the can filled with the content, wherein a circle curvature of a circular conveyance path of the forwarding turret is greater than a circle curvature of a circular conveyance path of the filling turret, a transport guide is provided in a transport portion from the filling turret to the forwarding turret, a guide surface shape of the transport guide is formed along a transition curve that continuously changes from the circle curvature of the circular conveyance path of the filling turret to the circle curvature of the circular conveyance path of the forwarding turret, thereby continuously changing a centrifugal force that is configured to be applied to the can filled with the liquid content, and a lid supply part is provided on the forwarding turret.

2. The can filling/seaming device according to claim 1, wherein acceleration applied on the can conveyed by the forwarding turret is set less than acceleration $a_{max}$ defined by the expression $a_{max}=(2h/D)\times G$, where h is a headspace height of the can, D is a diameter (body diameter) of the can, and G is gravitational acceleration.

3. The can filling/seaming device according to claim 1, wherein the circular conveyance path of the filling turret and the circular conveyance path of the forwarding turret are provided with a gap therebetween, and a can transport track is formed in the gap by the transport guide, a conveyance pitch is set for the filling turret and the forwarding turret within such a range that pocket pass is enabled during transport from the filling turret to the forwarding turret.

4. The can filling/seaming device according to claim 1, wherein a circle curvature of a circular conveyance path of the seamer is greater than the circle curvature of the circular conveyance path of the forwarding turret, another transport guide is provided at another transport portion from the forwarding turret to the seamer, and a guide surface shape of the another transport guide is formed along a transition curve that continuously changes from the circle curvature of the circular conveyance path of the forwarding turret to the circle curvature of the circular conveyance path of the seamer.

5. The can filling/seaming device according to claim 1, wherein a branching forwarding turret is provided in the circular conveyance path of the forwarding turret, the branching forwarding turret branching the circular conveyance path of the forwarding turret to a capper that caps a cap to a mouth part of a bottle can.

6. The can filling/seaming device according to claim 1, wherein the filler, the seamer, and the forwarding turret are placed on a common frame.

7. The can filling/seaming device according to claim 1, wherein the circular conveyance path of the filling turret and the circular conveyance path of the forwarding turret are provided with a gap therebetween such that no point on the circular conveyance path of the filling turret coincides with any point on the circular conveyance path of the forwarding turret.

8. A can filling/seaming method using the can filling/seaming device of claim 1, the method comprising:

filling the can, via the filler, with the liquid content while conveying the can along the circular conveyance path of the filling turret;

transporting the can filled with the content from the filling turret to the forwarding turret and supplying the can with the lid while conveying the can along the circular conveyance path of the forwarding turret; and transporting the can supplied with the lid from the forwarding turret to the seamer and attaching the lid to the can by double-seaming while conveying the can along the circular conveyance path of the seamer, wherein the circle curvature of the circular conveyance path of the forwarding turret is greater than the circle curvature of the circular conveyance of the filling turret, the transporting from the filling turret to the forwarding turret is formed along a transition curve that continuously changes from the circle curvature of the circular conveyance path of the filling turret to the circle curvature of the circular conveyance path of the forwarding turret, thereby continuously changing a centrifugal force that is configured to be applied to the can filled with the liquid content.

9. The can filling/seaming method according to claim 8, wherein acceleration applied on the can conveyed by the forwarding turret is less than acceleration defined by $a_{max}=(2h/D)\times G$, where h is a headspace height of the can filled with the content, D is a diameter of the can, and G is gravitational acceleration.

10. The can filling/seaming method according to claim 8, wherein a circle curvature of the circular conveyance path of the seamer is greater than the circle curvature of the circular conveyance path of the forwarding turret, transport from the forwarding turret to the seamer is carried out along a transition curve that continuously changes from the circle curvature of the circular conveyance path of the forwarding turret to the circle curvature of the circular conveyance path of the seamer.

11. The can filling/seaming method according to claim 8, wherein the conveyance path of the forwarding turret branches to a capper that caps a cap to a mouth part of a bottle can.

* * * * *